United States Patent [19]

Shreir

[11] 4,235,681

[45] Nov. 25, 1980

[54] ANODES FOR CATHODIC PROTECTION AND OTHER ELECTROLYTIC PROCESSES

[76] Inventor: Lionel L. Shreir, 18A Elmwood Ave., Kenton, Harrow, Middlesex HA3 8AH, England

[21] Appl. No.: 84,773

[22] Filed: Oct. 15, 1979

[51] Int. Cl.[3] ..... C25B 11/04; C25D 15/00; C25D 15/48; C25D 3/34

[52] U.S. Cl. ..... 204/16; 204/35 R; 204/53; 204/291

[58] Field of Search ..... 204/291, 53, 35 R, 16

[56] References Cited

U.S. PATENT DOCUMENTS

| | | | |
|---|---|---|---|
| 1,079,269 | 11/1913 | Seeger | 204/291 |
| 3,232,858 | 2/1966 | Holmes et al. | 204/291 |

FOREIGN PATENT DOCUMENTS

| | | | |
|---|---|---|---|
| 1001017 | 8/1965 | United Kingdom | 204/16 |
| 1480343 | 7/1973 | United Kingdom | 204/16 |

*Primary Examiner*—R. L. Andrews

*Attorney, Agent, or Firm*—Lowe, King, Price & Becker

[57] ABSTRACT

The invention relates to an anode comprising a composite of lead or a lead alloy and magnetite in which small particles of magnetite are dispersed in a matrix of lead or a lead alloy. The invention also relates to a process for making a composite anode in which a powder of magnetite and a lead or lead alloy powder are mixed together and the resulting mixture is compacted together by being subjected to the effect of sufficient pressure to achieve at least partial sintering on the surfaces of the contacting particles of the mixed powders. The anode according to the invention is suitable for use in cathodic protection and other electrolytic processes.

9 Claims, No Drawings

ANODES FOR CATHODIC PROTECTION AND OTHER ELECTROLYTIC PROCESSES

This invention relates to anodes for cathodic protection and other electrolytic processes and is particularly concerned with lead-magnetite anodes for such purposes.

A variety of electron-conducting materials have been proposed and used as anodes in impressed current cathodic protection systems. These include electrodes composed of platinum or platinum-coated titanium or niobium, the substrates of which are inert under the electrolysis conditions, partly inert materials such as lead alloys or silicon-iron, and materials such as scrap iron or aluminium which are in fact attacked or take an active part in the electrolysis process. Electron-conducting non-metals such as graphite and magnetite ($Fe_3O_4$) are used for certain applications.

An anode which is to be used for cathodic protection should ideally have the following properties:

(a) it should be completely inert even at high current densities;

(b) it should not polarise significantly;

(c) it should have a high electrical conductivity;

(d) it should be mechanically stable; and (e) it should be economical.

Few materials will satisfy all these requirements. Indeed, the variety of materials which are used in practice for these purposes indicates that the final decision as to the most appropriate material for a particular system will depend on a number of considerations including cost of materials amongst others.

Lead alloys have been widely used for some years in the cathodic protection of steel structures in sea water, and these have many of the advantages outlined above. The primary reaction when lead is anodically polarised in a chloride-containing solution is its oxidation to plumbous ion ($Pb^{2+}$), as follows:

$$Pb \rightarrow Pb^{2+} + 2e^- \quad (1)$$

Whether or not these ions remain in solution or react with the chloride ions to form sparingly soluble lead chloride will depend on solubility considerations which will also determine the position of the formation of lead chloride. At high current densities and in solutions containing an appreciable concentration of chloride ions, the concentrations of lead ions and chloride ions will be sufficient to result in rapid crystallisation of lead chloride at the surface of the lead, and since lead chloride is non-conducting the current obtained from the anode at a constant potential will decrease. Under these circumstances, the anode will cease to provide a current of sufficient magnitude to cathodically protect a steel structure. However, the anodic behaviour of lead is characterised by the formation of lead dioxide at elevated potentials by the oxidation of plumbous ion which is produced by the primary reaction. This second reaction is as follows:

$$Pb^{2+} + 2H_2O \rightarrow PbO_2 + 4H^+ + 2e^- \quad (2)$$

Under constant current conditions, the crystallisation of lead chloride on the surface of the lead will decrease the surface area with a consequential increase in the current density and anode potential, and this will result in the oxidation of plumbous ions to lead dioxide.

Lead dioxide, unlike lead chloride, is a semi-conductor with an electrical conductance of approximately 16% that of metallic lead, and its formation as a continuous, adherent film on the surface of the lead will result in the passivation of the anode. Thus, the corrosion of the lead giving either non-conducting lead chloride or electron-conducting lead dioxide will be replaced by the following reaction:

$$2Cl^- \rightarrow Cl_2 + 2e^- \quad (3)$$

Under these circumstances, the $Pb/PbO_2$ system will behave as an inert anode in which the passage of the charge will be mainly confined to the oxidation of chloride ions in solution to gaseous chlorine and to the oxidation of water to gaseous oxygen.

During the anodic polarisation of lead in chloride solutions, there is a delicate balance between formation of lead chloride with consequential corrosion and ultimate disintegration of the anode, and the formation of passivating lead dioxide. It has been shown that alloying additions of silver promote the adhesion of the lead dioxide to the lead, and anodes containing 1 to 2% by weight of silver have been widely used for cathodic protection and for electrolytic processes such as "electrowinning".

The role of the silver is still not understood, but it is possible that the fine crystals of silver in the lead act as stable nuclei for the deposition of the lead dioxide, which once formed cannot be undermined and detached by subsequent formation of lead chloride. Anodes of this type may be operated at current densities in the range of from 100 to 200 $Am^{-2}$ for prolonged periods in sea water, but are unsatisfactory in brackish or fresh waters.

A further important development in the design of lead anodes for cathodic protection was the discovery that micro-electrodes of platinum, or like inert conductive materials, when inserted into the surface of the lead greatly enhanced its stability. A typical anode of this type consists of a lead or lead alloy rod 25 mm in diameter by 2 m in length, in which micro-electrodes of platinum wire (0.5 mm dia$\times$8 mm) are inserted at approximately 0.25 m intervals. These microelectrodes project from the surface of the rod by about 0.5 mm. The resulting $Pb/PbO_2$ - Pt bielectrode can be operated in sea water at up to 1000 $Am^{-2}$ although current densities in the range of from 200 to 750 $Am^{-2}$ are normally used. Again, the precise role of the platinum is not fully understood, although there is evidence to show that (a) the platinum acts as a nucleus for the crystallisation of the lead dioxide, and (b) it prevents the breakdown of the lead dioxide with consequent corrosion of the anode. However, the lead-platinum bielectrode suffers from the same limitations as the Pb-Ag alloys in that it cannot be used in fresh or brackish water in which it tends to form an insulating film of one or more non-conductive lead compounds such as basic lead carbonate.

Recently, magnetite anodes have become available for use in cathodic protection systems. Only a few details of the manufacture and compositions of these anodes have been available, but it appears from such details as have been made public that the process of manufacture is difficult and expensive, as one would expect from the high melting point of magnetite (1540° C.). The available literature suggests that the magnetite employed is made castable by the addition of other minerals, but since the cast magnetite is extremely hard it cannot be subsequently rolled, extruded or machined, so that the shapes available are confined to lengths of cylindrical tube of 60 mm diameter and wall thickness about 10 mm. A major advantage claimed for these anodes is that they can be used in sea water and in soils and waters of high resistivity, although in all environments the maximum current density is only about 100 $Am^{-2}$. On the other hand, a major disadvantage of the anodes is their extreme brittleness, which means that they must be handled with care during installation owing to the danger of impact leading to fracture.

I have sought to avoid the disadvantages discussed above of the anodes used and proposed for cathodic protection or like electrolysis systems.

According to one aspect of my invention, I provide an anode comprising a composite of lead or lead alloy and magnetite in which small particles of magnetite are dispersed in a matrix of lead or a lead alloy. In general, the proportion of magnetite may be in the range of from 0.1 to 70% by weight, preferably from 0.5 to 50% by weight, of the total lead- or lead alloy-magnetite composition. In the case of an anode for use in sea or other highly conductive waters, at current densities up to 700 $Am^{-2}$, I prefer to use a composite of lead or lead alloy and magnetite, in which the magnetite constitutes from 0.1% to 10% by weight of the total composition. On the other hand, in the case of an anode for use in fresh or brackish water or in soils at current densities up to 100 $Am^{-2}$, I prefer to use a composite of lead- or lead alloy-magnetite containing from 10 to 50% by weight of magnetite based on the total composition.

According to another aspect of the invention, the composite of the lead or lead alloy and the magnetite is prepared by mixing powders of these two materials intimately together and thereafter compacting them together. The particle sizes of lead or lead alloy and of the magnetite components are normally in the range of from −10 to +100 mesh. Mesh sizes herein are according to British Standard 410. In order to produce composites of adequate mechanical and electrochemical properties the particle sizes of the lead and magnetite powders must be varied according to composition. Thus, for composites of less than about 20% magnetite, relatively coarse particles in the range −10 to +20 mesh are preferable, whereas for composites containing a higher proportion of magnetite finer powders in the range −20 to +100 mesh are preferred.

I have demonstrated that crystals of magnetite dispersed throughout the lead or lead alloy behave in a similar manner to silver alloying additions and/or platinum microelectrodes. In other words, the magnetite markedly affects the anodic behaviour of the lead or lead alloy, and appears to stimulate the formation on the surface of the lead or lead alloy anode of a stable film of lead dioxide in the same way as alloying additions of silver or microelectrodes of platinum.

Furthermore, I have shown that the electrochemical properties of the lead/magnetite composite vary with the concentration of magnetite, thus giving rise to materials which on the one hand are similar to lead-silver alloys, or lead containing platinum microelectrodes, and on the other hand are similar to magnetite supported in a ductile and electrically conductive lead matrix. This means that composites containing a low concentration of magnetite may be used at high current densities in sea water, whereas those containing high concentrations of magnetite may be used in either sea water or fresh water, or in soils, providing the current density is maintained at a low value.

The manufacture of lead containing a dispersion of magnetite by melting and casting techniques is not feasible owing to the large difference in density between molten lead (density about 11.4 g. $cm^{-3}$) and magnetite (density about 5.18 g. $cm^{-3}$). For this reason, according to a preferred aspect of the invention, the powders of the lead or lead alloy on the one hand, and the magnetite on the other, which are mixed together, are preferably compacted together at an elevated pressure. Since lead sinters at ambient temperatures, it is possible to achieve the desired coherence of the anode product by simply mixing the two powders together and compacting them at sufficiently elevated pressure. This produces a compacted anode with adequate mechanical properties for its intended use in certain applications.

The pressure required to consolidate the composite varies with the proportion of magnetite. For concentrations of magnetite up to about 20% by weight, pressures in the range of from 5 to 30 tons per square inch (796 to 4720 $kg/cm^2$) are sufficient. Higher pressures of up to 60 tons per square inch (9440 $kg/cm^2$) are required for higher concentrations of magnetite.

Lead is available commercially in the form of metal powders of various particle sizes, and natural magnetite can be readily crushed to produce powder and sieved to produce a material of the specified mesh size. It is possible, therefore, to produce composites by compressing together mixtures of lead and magnetite powders with mesh sizes within the ranges referred to above. I have found that the electrochemical and mechanical properties of the resulting composites vary according to the concentrations of the magnetite and also according to its particle size in the composite. Thus, when the magnetite is kept at low concentrations (0.1 to 10%), the anode obtained behaves in a manner similar to that of lead containing platinum microelectrodes, and the mechanical properties of the material are then similar to those of lead. The composites obtained with these proportions of magnetite and lead, respectively, can then be rolled and extruded to produce different shapes of anodes. As the concentration of the magnetite is increased, the electrochemical properties tend to resemble those of a magnetite anode in which the matrix of lead provides a supporting conductive material. Thus, the mechanical properties of the composites decrease as the concentration of the lead increases, and above about 50% of magnetite, the composite becomes mechanically weak and brittle and is more susceptible to corrosion during anode polarisation.

An alternative method of preparing composites of high magnetite content is to coat fine magnetite particles with an electrodeposited coating of lead using a lead fluoborate plating bath. The powder is plated in a manner similar to 'barrel plating' used for plating small components. The magnetite is made cathodic by a contactor and is rotated during electroplating to ensure that all surfaces are coated with lead. After the required amount of lead has been deposited on the magnetite, the powder is washed, dried and compacted under pressure.

The invention is illustrated by the following Examples:

EXAMPLE 1

33 g of magnetite with a mesh size in the range of from −10 to +20 were thoroughly mixed with 300 g of powdered lead with a mesh size in the same range to produce a composite containing 10% of magnetite. The resulting mixture was then compressed at a pressure of 20 tons per square inch 3150 kg/cm$^2$ in a steel die to give a composite 2.5 cm in diameter by 2.5 cm in length, which had mechanical properties comparable with those of lead alone. Tests were carried out in the laboratory by making the composite the anode in a solution corresponding in composition to that of sea water. These tests showed that current densities of up to 500 Am$^{-2}$ could be applied without significant polarisation, and the lead was observed to form an adherent and coherent deposit of lead dioxide.

EXAMPLE 2

A similar procedure was adopted to that in Example 1 to prepare a composite containing 40% magnetite but using powders of mesh size −80 to 100. The resulting composite, after being prepared by compacting under pressure, was made anodic in brackish water (resistivity 500 Ωcm) at a current density of 100 Am$^{-2}$. The degree of polarisation was similar to that obtained with the 10% magnetite-lead composite in artificial sea water at 700 Am$^{-2}$, and no undue corrosion of the lead or formation of an insulating film was observed.

Although lead-magnetite composites are satisfactory for most purposes, a further improvement in mechanical properties and electrochemical behaviour when anodically polarised may be achieved by using powders of lead alloys in place of lead, and alloy powders containing 0.1 to 2% of silver and up to 6% of antimony or alloys containing low concentrations of up to 5% of tellurium or selenium may be used for this purpose. Similarly, a further improvement in properties may be achieved by inserting platinum microelectrodes into the surface of the lead-magnetite or the lead alloy-magnetite composite.

Although powder metallurgy is the preferred method for making lead/magnetite composites, they can also be manufactured by electrodeposition of lead. The barrel-plating method has already been referred to, and another embodiment will now be described.

A conventional lead plating solution, e.g. a lead fluoborate or a lead fluosilicate plating bath, is used in which the powdered magnetite of the appropriate particle size is maintained in suspension by mechanical stirring and/or sparging with gas bubbles (e.g. air or nitrogen). The lead is electrodeposited on to a cathode, and during electrodeposition the magnetite particles become occluded in the electrodeposited lead. A similar technique is widely used for the preparation of composites in which one component is readily electrodeposited whilst the other is inert in the solution and is in the form of a fine powder that can be maintained in suspension, e.g. nickel containing aluminium oxide, which is a method of producing dispersion-strengthened nickel.

It is possible to control the content of magnetite by adjusting its concentration in suspension in the plating bath and/or by adjusting the current density used for electrodepositing the lead.

This method may be used to produce a composite that is subsequently fabricated into anodes or for the direct production of anodes. In the former, the composite is electrodeposited onto a cathode e.g. of graphite or stainless steel, from which it can be stripped and then cold fabricated into the required shape by mechanical deformation. However, a preferred process is to use electrodeposition to directly produce an anode consisting of a core of lead, or other conducting material such as copper or titanium, onto which is electrodeposited a thick layer of the lead-magnetite composite. For example, a lead or lead alloy rod of about 25 mm diameter is used as the cathode, and is coated with the composite of thickness 5 to 12 mm by electrodeposition, thus providing a finished anode. The anode thus comprises an outer sheath of lead/magnetite composite and an inner conducting core of metal. As an alternative, a lead rod of greater diameter may be used with a thicker coating of composite, and the anode thus produced is then reduced in section by extrusion.

I claim:

1. An anode comprising a composite of lead or a lead alloy and magnetite in which small particles of magnetite are dispersed in a matrix of lead or a lead alloy.

2. An anode as claimed in claim 1, wherein the proportion of magnetite is from 0.1 to 70% by weight of the total lead- or lead alloy-magnetite composition.

3. An anode as claimed in claim 1, wherein the particle size of the magnetite is in the range of from −10 to +100 mesh.

4. A process for making a composite anode in which a powder of magnetite and a lead or lead alloy powder are mixed together and the resulting mixture is compacted together by being subjected to the effect of sufficient pressure to achieve at least partial sintering on the surfaces of the contacting particles of the mixed powders.

5. A process as claimed in claim 4, wherein the particle sizes of the magnetite and of the lead or lead alloy powder are in the range of from −10 to +100 mesh.

6. A process for making a composite anode in which a powder of magnetite is coated with lead by electrodeposition, and the powder after washing and drying is then compacted by applying sufficient pressure to sinter the powder.

7. A process as claimed in claim 6, in which the magnetite powder is made the cathode in a rotating barrel containing a lead plating solution.

8. A process for making a composite anode, which comprises electrodepositing lead from a lead plating solution containing particles of magnetite in suspension onto a cathode.

9. A process as claimed in claim 8, wherein the cathode is a metal rod and the anode produced comprises an outer sheath of lead/magnetite composite and an inner conducting core of metal.

* * * * *